US012453996B2

(12) United States Patent
Jackson

(10) Patent No.: US 12,453,996 B2
(45) Date of Patent: Oct. 28, 2025

(54) AUTOMOBILE DENT PULLER APPARATUS

(71) Applicant: Mark Jackson, Lanexa, VA (US)

(72) Inventor: Mark Jackson, Lanexa, VA (US)

( * ) Notice: Subject to any disclaimer, the term of this patent is extended or adjusted under 35 U.S.C. 154(b) by 0 days.

(21) Appl. No.: 18/220,391

(22) Filed: Jul. 11, 2023

(65) Prior Publication Data

US 2023/0347398 A1 Nov. 2, 2023

Related U.S. Application Data

(63) Continuation-in-part of application No. 16/848,800, filed on Apr. 14, 2020, now Pat. No. 11,738,381.

(60) Provisional application No. 62/876,828, filed on Jul. 22, 2019, provisional application No. 62/833,729, filed on Apr. 14, 2019.

(51) Int. Cl.
*B21D 1/06* (2006.01)
*B21D 1/14* (2006.01)

(52) U.S. Cl.
CPC ..... *B21D 1/06* (2013.01); *B21D 1/14* (2013.01); *Y10S 72/705* (2013.01)

(58) Field of Classification Search
CPC ..... Y10S 72/705; B21D 1/14; B21D 1/12
See application file for complete search history.

(56) References Cited

U.S. PATENT DOCUMENTS 3,034,564 A * 5/1962 Cavazos ..... B21D 1/14 72/392
3,108,629 A * 10/1963 Jenkins ..... B60S 5/00 72/457
3,122,194 A * 2/1964 Bronson ..... B21D 1/14 72/705
3,149,659 A * 9/1964 Bogert, Jr. ..... B21D 1/14 72/705
3,276,237 A * 10/1966 Transue ..... B21D 1/145 72/305
3,566,667 A * 3/1971 Hagerty ..... B21D 1/12 72/705
3,577,881 A * 5/1971 Markovics ..... B21D 1/14 72/392
3,584,836 A * 6/1971 Brubaker, Sr. ..... B21D 1/14 72/705
3,698,230 A * 10/1972 Buske ..... B21D 1/14 72/705
3,808,866 A * 5/1974 Brabant ..... B21D 1/14 72/705
3,817,074 A * 6/1974 Crosthwaite ..... B21D 1/14 72/705
3,835,692 A * 9/1974 Hoffman ..... B21D 1/14 72/705

(Continued)

FOREIGN PATENT DOCUMENTS

WO WO-2022148819 A1 * 7/2022 ..... B21D 1/12

OTHER PUBLICATIONS

WO-2022148819-A1 Translation (Year: 2022).*

*Primary Examiner* — Michael W Hotchkiss
(74) *Attorney, Agent, or Firm* — Anthony Tacconi, Esq.; IPCL Group PLC

(57) ABSTRACT

A novel dent-puller assisting apparatus is disclosed herein. The invention provides a stable anchor point for the attachment of a variety of mechanisms to be used in the process of straightening or repair of car body panels. The invention is designed to require a minimum number of parts and connections, be portable and easily transported, and have sufficient flexibility to accomplish the required ends.

5 Claims, 12 Drawing Sheets

(56) References Cited

U.S. PATENT DOCUMENTS 3,955,397 A * 5/1976 Meis ..... B21D 1/14 72/705
3,985,014 A * 10/1976 Smith ..... B21D 1/14 72/457
3,992,919 A * 11/1976 Jarman ..... B21D 1/12 72/457
4,057,994 A * 11/1977 Wolgast ..... B21D 1/14 72/705
4,309,895 A * 1/1982 Samuelsson ..... B21D 1/14 72/457
4,519,236 A * 5/1985 Celette ..... F16B 2/12 403/201
4,720,991 A * 1/1988 Kuhn ..... B21D 1/14 72/457
4,747,579 A * 5/1988 Rich ..... B21D 1/14 254/386
4,748,842 A * 6/1988 Dingman ..... B21D 1/14 72/457
4,791,802 A * 12/1988 Celette ..... B21D 1/14 72/705
4,802,358 A * 2/1989 Cavaca ..... B21D 1/14 72/308
4,813,264 A * 3/1989 Trice ..... B21D 1/14 72/705
4,827,759 A * 5/1989 Mattson ..... B21D 1/14 72/705
4,959,991 A * 10/1990 Andersson ..... B21D 1/14 72/705
5,101,654 A * 4/1992 Stevens ..... B21D 1/14 72/705
5,730,019 A * 3/1998 Venalainen ..... B21D 1/14 72/305
6,182,493 B1 * 2/2001 Weschler ..... B21D 1/145 72/457
6,216,524 B1 * 4/2001 Weschler ..... B21D 1/145 72/457
6,490,906 B1 * 12/2002 Bailey ..... B25H 1/0007 72/457
7,269,990 B1 * 9/2007 Espinosa ..... B21D 1/14 72/457
7,549,313 B2 * 6/2009 Espinosa ..... B21D 1/14 72/457
9,149,849 B2 * 10/2015 Giacomini ..... B21D 1/12
10,625,318 B2 * 4/2020 Venalainen ..... B21D 1/14
2004/0103711 A1 * 6/2004 McIlwraith ..... B21D 1/145 72/293

* cited by examiner

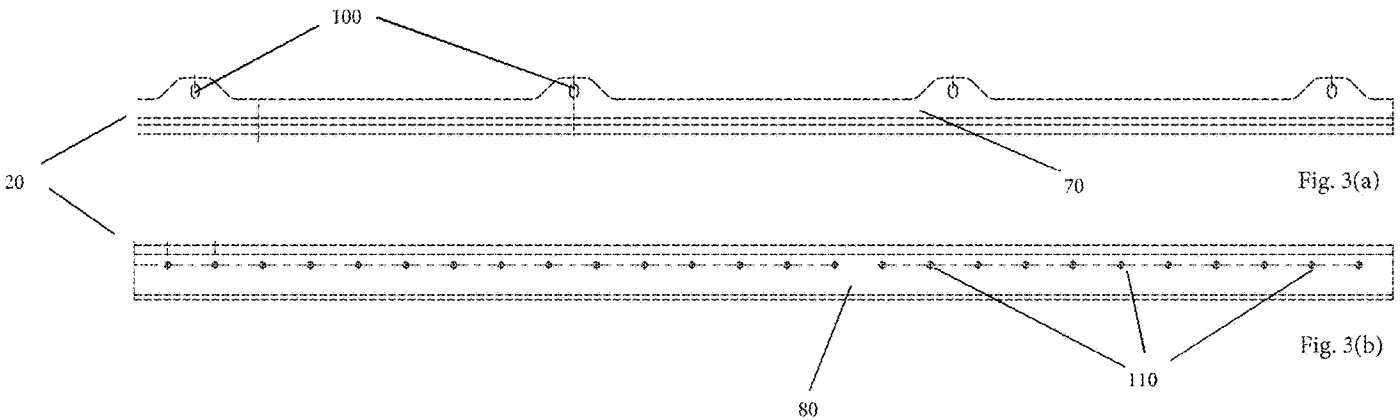
Fig. 3(a)
Fig. 3(b)
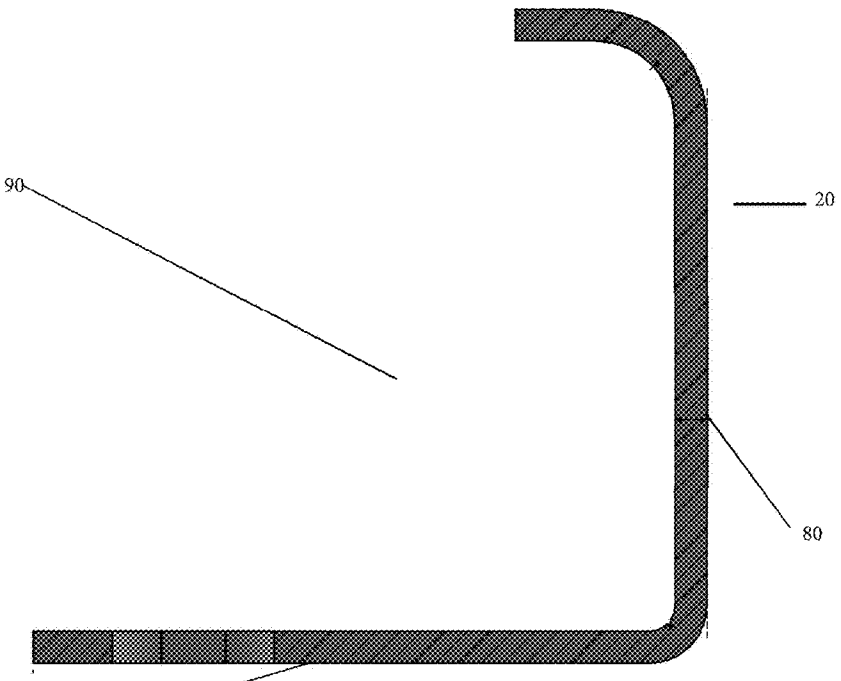
Fig. 3(c)

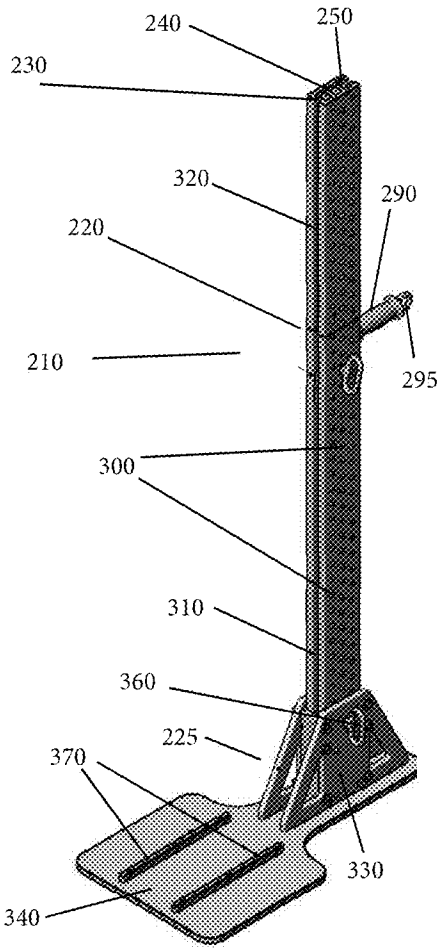
Fig. 6(a)
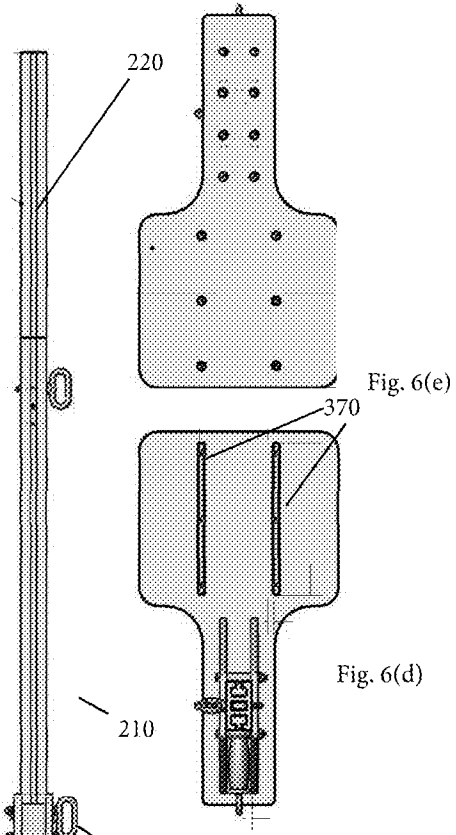
Fig. 6(e)
Fig. 6(d)
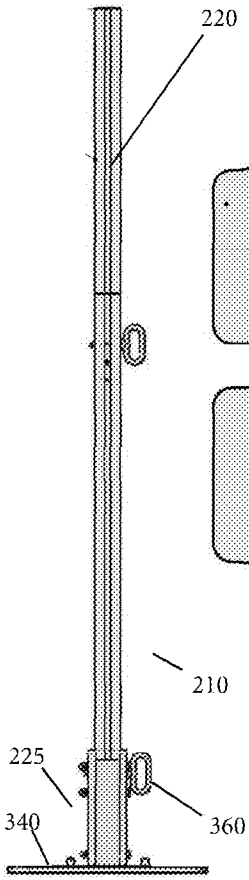
Fig. 6(c)
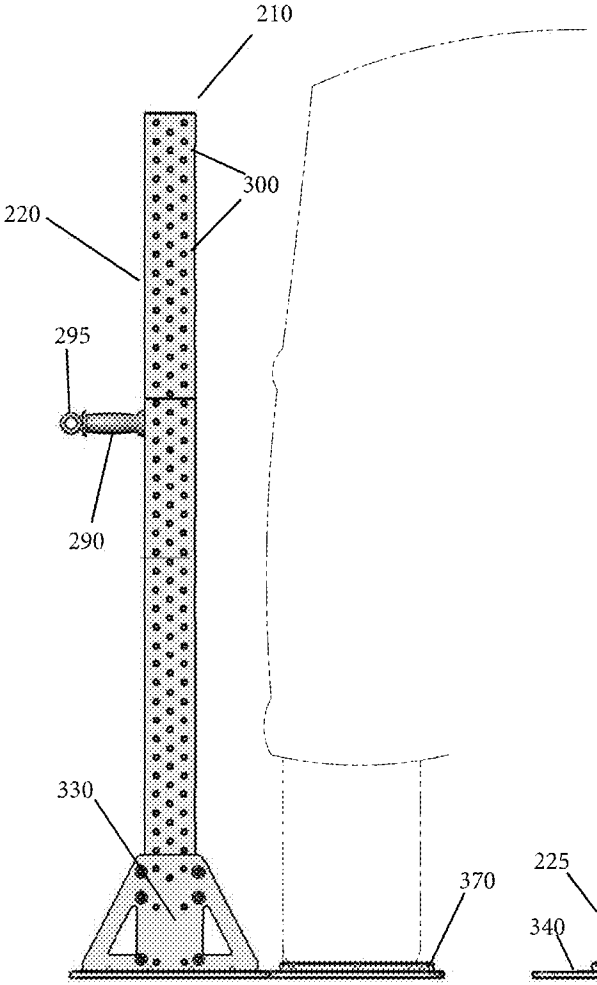
Fig. 6(b)

AUTOMOBILE DENT PULLER APPARATUS

This application claims priority from, and is a continuation-in-part of, U.S. patent application Ser. No. 16/848,800. Further, this application claims priority from U.S. Provisional Patent Application Nos. 62833729 filed on Apr. 14, 2019 and 62/876,828 filed on Jul. 22, 2019.

FIELD OF THE INVENTION

The present invention relates to automotive dent removers and pullers, and, more specifically, equipment to assist in the removal of dents and dings from the body panels of automobiles, trucks, and other vehicles, and methods of use thereof.

BACKGROUND OF THE INVENTION

Over the course of its lifetime, an automobile, or vehicle of any type, may sustain numerous dents and dings to its body as a result of minor impacts or collisions. The means for repairing such dents is dependent on the severity and location of the damage. Extensive damage will often require removal of the damaged portion of the automobile, repair, and reattachment. In addition to the labor intensive steps of removal, reinstallation, and dent repair, the repaired section must be sanded and properly repainted. Even in cases where complete removal of a body panel is not warranted, traditional mechanisms of dent repair would, inter alia, sand the damaged area, pull the dents out to the extent possible, filling or raising any depressed areas, and then repainting; again, all labor intensive tasks.

Paintless dent repair techniques and equipment make minor dent repair considerably easier. Depending on the level of access behind the dent or ding, minor dents and dings can be removed through the use of rods and access tools to push the dent out. More importantly, paintless dent repair often involves the use of glue and glue tabs to attach a pulling tool or device to the dent in order to pull the dent out. Although a simple rod or handle can be attached via this mechanism, larger or deeper dents often require the use of a slide hammer or similar tool.

The larger the strip or tab that is used and the deeper the depression of the dent, the greater pulling force required to pull the strip or tab, and commensurately, the dent out. Further, it is advantageous to pull multiple tabs concurrently. Pulling multiple tabs at the same time improves the quality of the repair and also increases the speed and efficiency of the repair process. A technician using a slide hammer or other tool is limited to pulling at one location at a time. There is, therefore, a need for an apparatus to provide assistance with dent repair in general which overcomes these difficulties and improves repair efficiency.

SUMMARY OF THE INVENTION

The present invention teaches a mobile anchor point for use in the repair of dents and dings in automobiles and other vehicles. A first embodiment provides a floor mounted gantry which provides an anchor point for a dent removal tool. A second embodiment provides a mobile anchor point for a dent removal tool which uses the weight of the automobile or vehicle which is being repaired as the counterweight to provide the anchor.

BRIEF DESCRIPTION OF THE DRAWINGS

FIG. 3(*a*) is a first leg of a floor rail.

FIG. 3(*b*) is a second leg of a floor rail.

FIG. 3(*c*) is an end view of a floor rail.

FIG. 4(*b*) is a cut-away side view of the wheel housing.

FIG. 6(*a*) is a perspective view of a second embodiment of the invention.

FIG. 6(*b*) is a side view of a second embodiment of the invention.

FIG. 6(*c*) is a rear view of a second embodiment of the invention.

FIG. 6(*d*) is a top plan view of the base plate.

FIG. 6(*e*) is a bottom plan view of the base plate.

FIG. 9(*b*) is a second illustration of the second embodiment in use.

DETAILED DESCRIPTION

The invention provides a mobile anchor point which provides assistance to those engaged in the repair of dents and dings in automobiles and other such vehicles.

Figure 1:
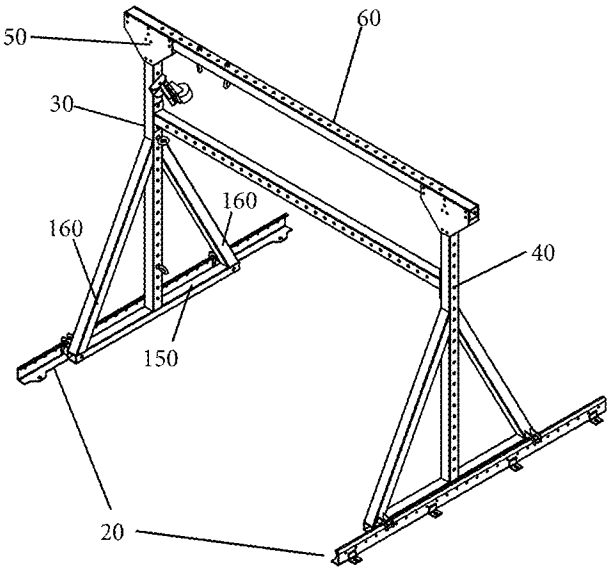
FIG. 1 is a perspective view of a first embodiment of the invention.
Figure 2:
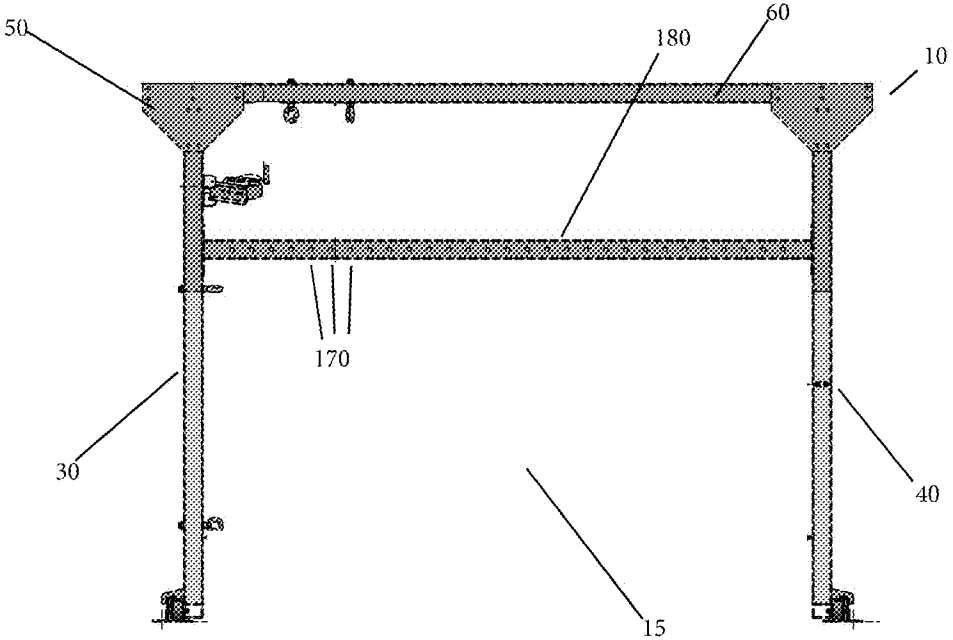
FIG. 2 is an end view of a first embodiment of the invention.

The first embodiment of the invention, shown in FIGS. 1 and 2, provides a floor-mounted gantry 10 that can serve as an anchor point to attach a dent pulling tool or device. The frame of the apparatus 10 consists of two floor rails 20, two upright support beams 30, 40, two mounting plates 50, and a horizontal crossbeam beam 60 extending between the support beams 30, 40.

As illustrated in FIGS. 3(*a-b*), each floor rail 20 is essentially L-shaped having two extended sections comprising a first leg 70 and a second leg 80. The L-shape results in the creation of a wheel-track 90 in each floor rail 20. Each leg 70, 80 has a set of apertures running along the length of the rail. A first set of oval shaped holes 100 is to be used to secure each rail 20, and commensurately the whole gantry 10, to the floor. A second set of holes 110 is to be used to mount one or more rods, or other such locking mechanisms, to prevent travel of the frame when the gantry is in operation. Said first leg having a slight curvature at the terminal portion 120 of said leg which results in a small portion of said leg extending parallel to said second leg and serving to form the upper portion of the wheel-track 90.

Figure 4B:
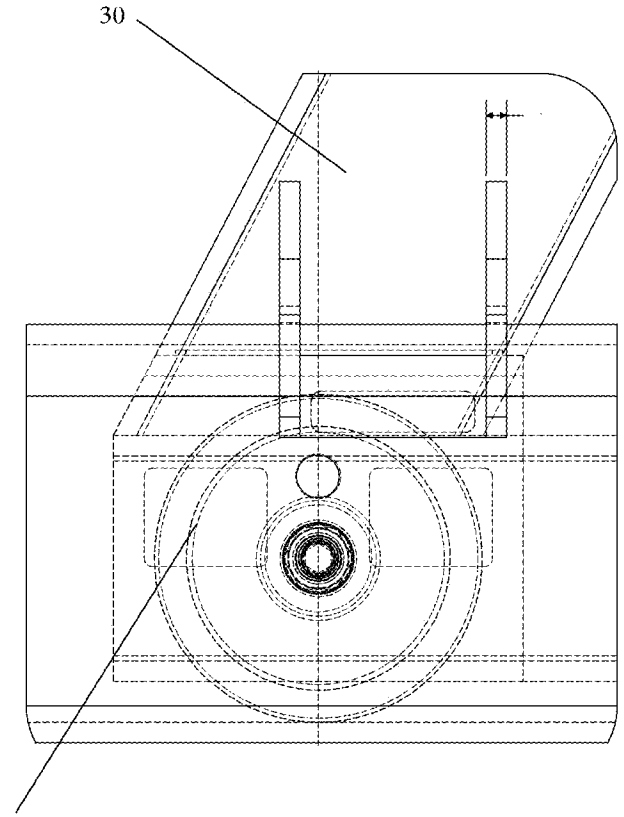
FIG. 4(*a*) is an end view of the wheel housing.
Figure 4A:
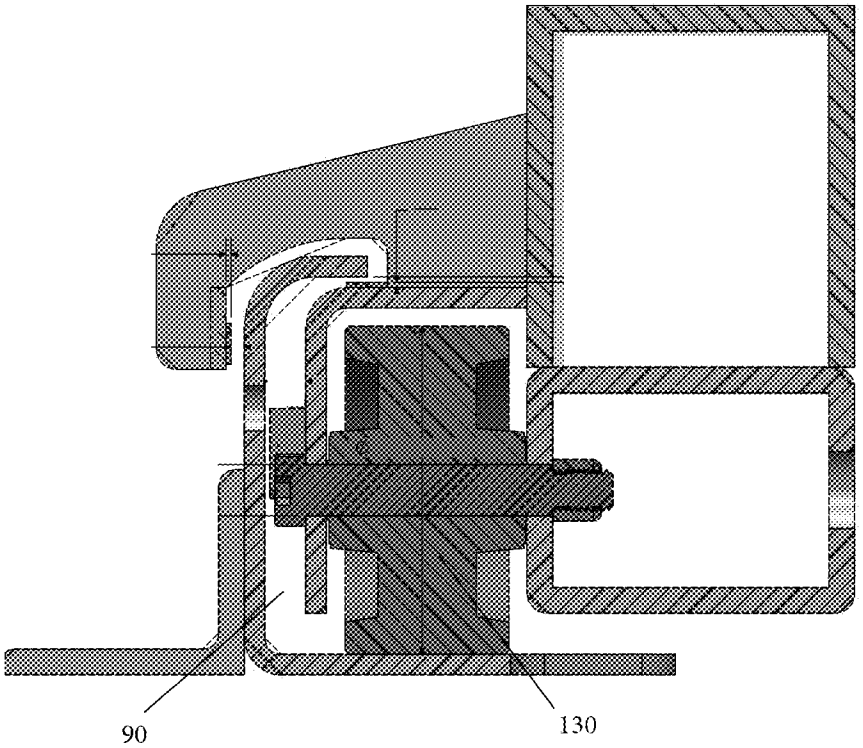
Figure 5:
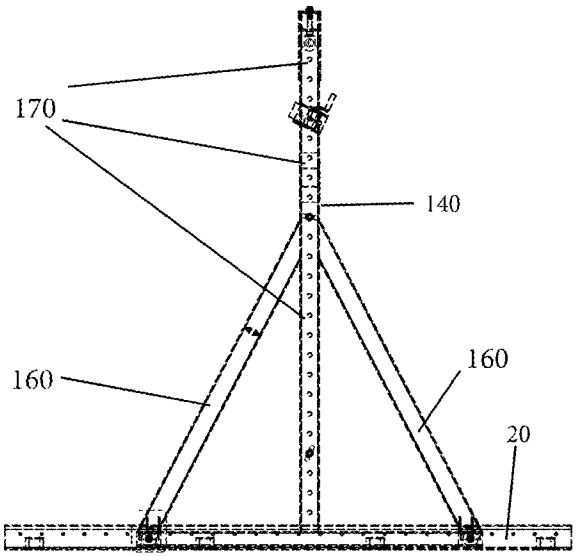
FIG. 5 is an illustration of an upright support beam.

Turning to FIGS. 4(*a*)-(*b*), the bottom of each upright support beam 30, 40 is connected to a wheel housing. A wheel 130 is mounted in each wheel housing. This wheel 130 is designed to fit into the wheel-track 90 formed within the space of the first and second legs 70, 80 of the floor rail 20. Each upright support beam 30, 40 is comprised of four elements, a primary support 140, a base component 150, and two secondary beams 160 as shown in FIG. 5. The primary member 140 lies in the same plane as the base component 150 and extends perpendicularly from the base 150. A secondary beam 160 is attached to each end of the base component and extends at approximately a forty-five degree angle until it intersects with the primary member. The four components can be welded together, affixed by any customary means of attachment, or be of unitary construction.

A plurality of mounting apertures 170 are positioned at regular intervals along the length of the primary portion of the support beams 30, 40 and the crossbeam 60. A conventional dent pulling tool, i.e. a device which can used to exert force, may be attached at any mounting hole location. For example, a winch (not shown) can be attached to the apparatus 10. Although such a device may be attached through a variety of means, one such option would rely upon a winch bracket affixed by a clevis pin, or any such means, to a mounting aperture 170. The winch is then secured to the winch bracket for use.

The gantry opening 15 is wide enough to accommodate a vehicle of average width while still allowing a certain amount of clearance between the sides of the vehicle and the respective upright support beams. In one embodiment, the total width of the structure from rail to rail would be approximately one hundred forty inches which would provide for approximately twenty-two inches of clearance between the side of the vehicle and each upright support beam. A cross beam anchor 180 may also be added to the structure to add additional mounting apertures 170 for repair of tailgates on SUVs and trucks. It will also be noted that the mounting plates 50 may be omitted and the gantry frame can be constructed without such elements.

Figure 7:
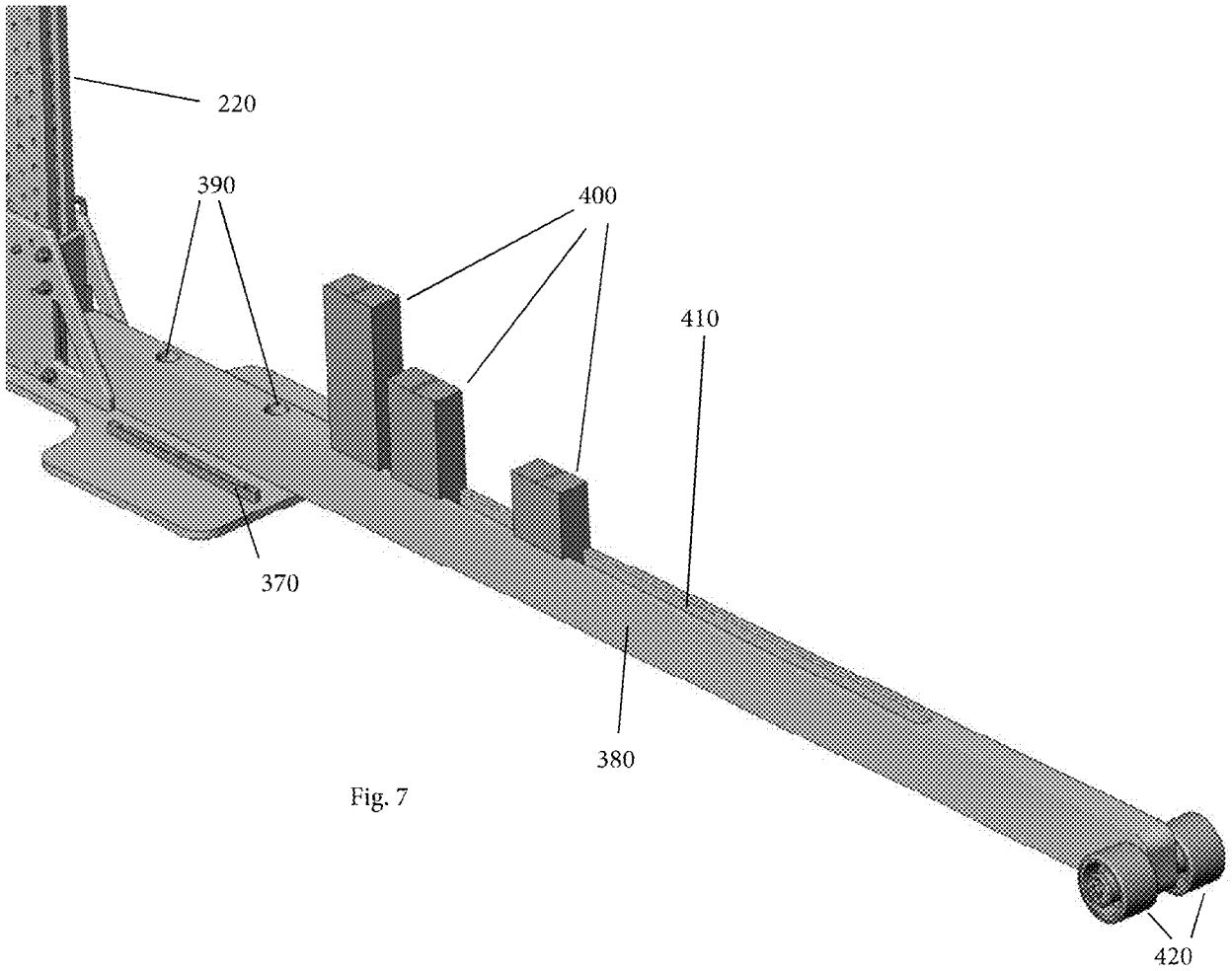
FIG. 7 is a perspective view of the foot rail with jack blocks.
Figure 8:
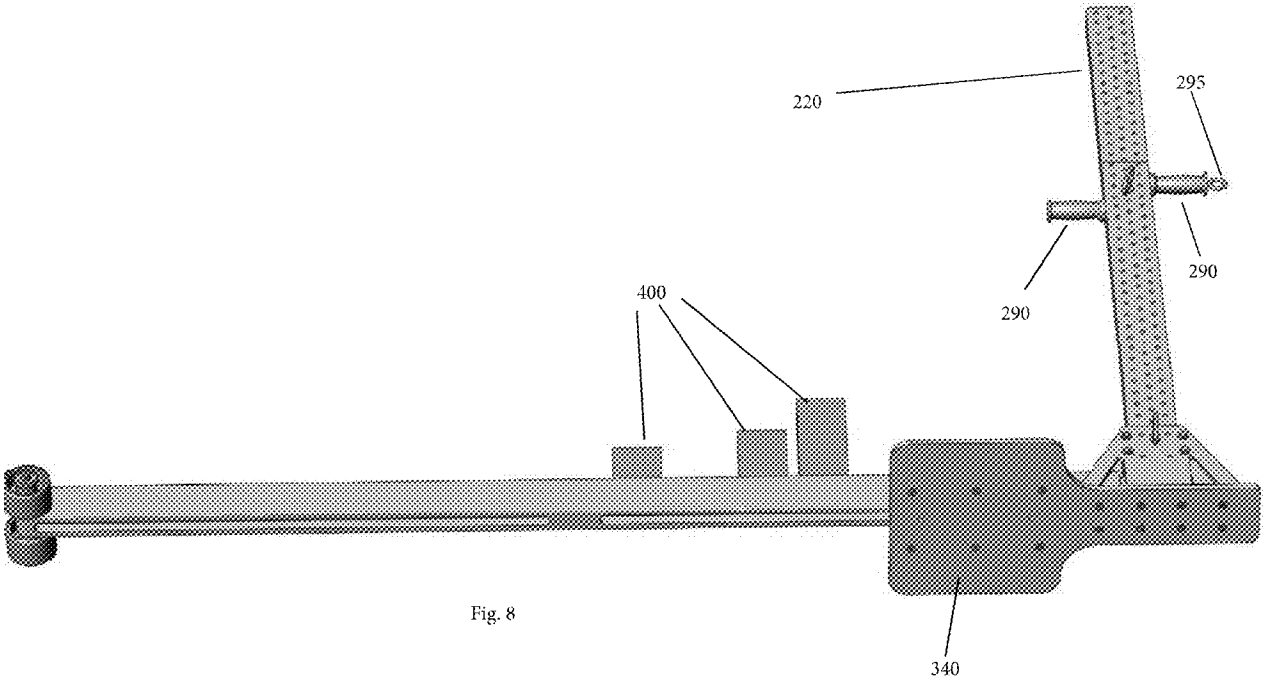
FIG. 8 is an underside perspective view of the foot rail with jack blocks.

The second and primary embodiment of the invention provides a mobile workstation which is an easily transportable apparatus that can be used to provide an anchor point for dent removal in the field. Referring now to FIGS. 6-8, this mobile version consists of three principal components, a vertical support beam 220, a base section 225, and an optional foot rail anchor extension.

The vertical support beam 220 is typically comprised of aluminum or material of similar tensile strength. The beam 220 has a front and back and two sides and further includes three channels 230, 240, 250 that run along the longitudinal axis of the beam and terminate in three respective apertures on either end of the beam 220. The center channel 240 is positioned in the middle of the beam. The front 230 and rear 250 channels are positioned on either side of the center channel 240. The front 230 and rear channels 250 are not entirely enclosed and include an opening disposed to receive a projection from a handle 290. The handle 290 can include a means to receive and attach a ratchet strap or other such tool, e.g., an anchor ring 295. The beam 220 includes a plurality of through-holes 300 along the length of the beam.

The vertical support beam 220 can be a single unitary element or be made up of two or more sections. In the preferred embodiment, the beam is made up of a primary element 310 and an extension element 320. The two elements can be affixed by a variety of conventional means but the extension element 320 may include a steel tang (not shown) which may be seated into the center channel 240 at the end of the primary element 310 and may be secured with a quick release pin. The beam is mounted in the base section 225.

The base section 225 is comprised of a receiving frame 330, a platform 340, and an optional foot rail 380 as shown in FIGS. 6, 7, and 8. The receiving frame is disposed to receive and stabilize the beam 220. The beam 220 is secured in place by means of a quick release pin 360. The platform 340 extends orthogonally from the receiving frame 330.

The platform 340 includes tire grabbing rails 370 to help restrict vehicle movement when a vehicle tire is used to anchor the workstation. Alternatively, a foot rail can be securely attached to the platform 340. The foot rail 380 extends outward from the base section 225. In the embodiment shown in FIG. 7, the foot rail 380 is secured to the platform 340 by two bolts (not-shown) which pass through apertures 390 in the foot rail 380. At least one jack block 400 is mounted on the foot rail 380. Jack blocks 400 of desired heights may be employed as desired. Each jack block 400 has a tang or such structure which slides into a groove 410 in the foot rail. A pair of wheels 420 is mounted at the second end 430 of the foot rail 380.

Figure 9A:
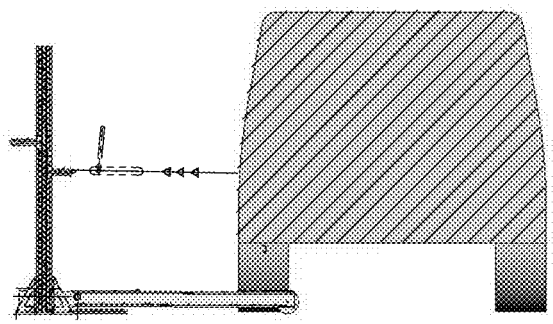
FIG. 9(*a*) is a first illustration of the second embodiment in use.
Figure 9B:
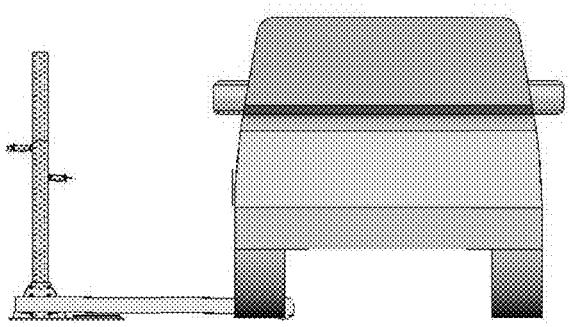
Figure 10:
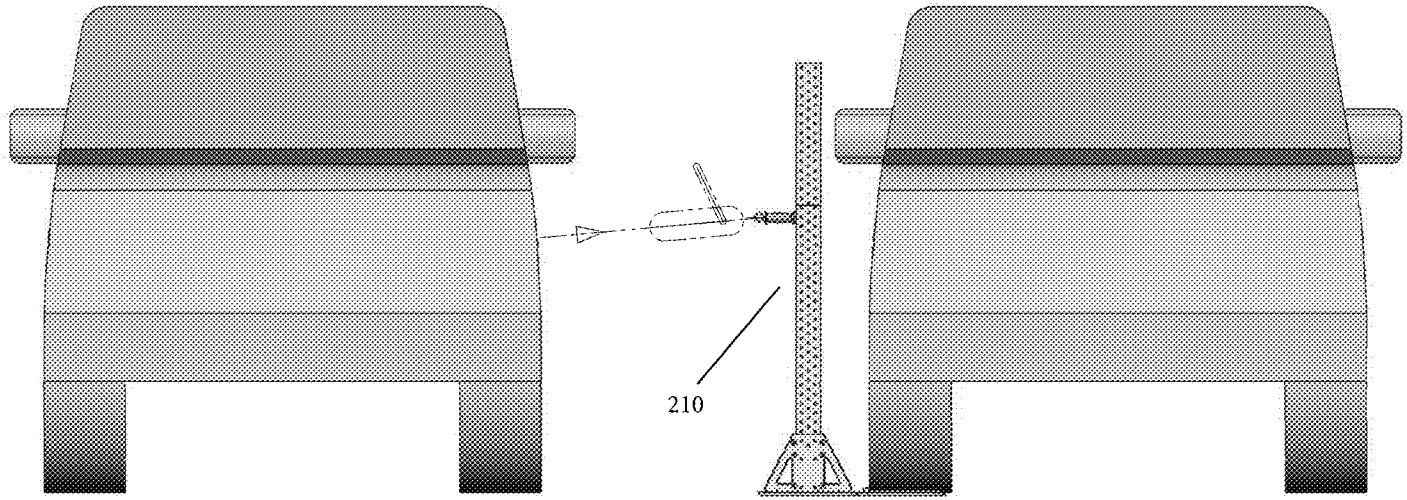
FIG. 10 is an illustration of an alternate operation of the second embodiment.

In operation, shown in FIGS. 9 and 10, the mobile workstation 210 is transported to the location of the automobile or vehicle which needs to be repaired. If the workstation has been broken down, e.g., the vertical support beam 220 has been removed from the base section, the workstation 210 would be reassembled prior to use. The foot rail 380 is positioned under the vehicle parallel to the dent being repaired. The beam 220 is positioned approximately two to three feet from the dented panel. The closer the beam is to the vehicle, the more pressure may be applied to the beam 220. Alternatively, if the dent is located above the wheel of a vehicle, the vehicle may be parked on top of the platform and the vehicle wheel situated in the tire grabbing rails 370. Further, as shown in FIG. 10, a second vehicle, i.e., a vehicle other than the one being repaired, may be parked on the platform 340 in order to stabilize and anchor the workstation 210.

In cases where the foot rail 380 is used, the vehicle is jacked up as close as possible to the foot rail 380 to accommodate the appropriate height jack block 400. The jack block 400 is placed in the foot rail 380 even with the frame or other component under the vehicle that will support the weight of the vehicle when the vehicle jack is lowered. The vehicle jack is lowered until the vehicle is resting on the jack block 400.

The adjustable handle 290 is positioned so that it is aligned with the dent to be repaired. A chain hoist, come-along, power puller, rachet strap, or any analogous mechanical device which may be used to generate a sufficient pulling force to pull the dented section to the desired position, as would be known to one of ordinary skill in the art, is then attached to the beam 220 or handle 290. For example, a ratchet strap or such tool may be hung from the anchor ring 295 and generally aligned with the dent. The length of the ratchet strap is adjusted to reach the dent. The desired glue tab(s) is/are applied to the dent. Once the glue has cooled and set, the remaining hook of the ratchet strap is attached to the glue tab(s). The ratchet strap is then used to apply tension to the glue tab(s) until the dent is pulled to the desired height. This process is repeated until the repair has been satisfactorily achieved.

It will be noted that instead of using glue tabs, the apparatus and method can be used with other dent repair equipment and techniques. For instance, the apparatus and method can be used in conjunction with weld pins or body studs which are welded to the dented area. The apparatus is then attached to the pins or studs and is used to exert the desired pressure in order to complete the repair.

Figure 11:
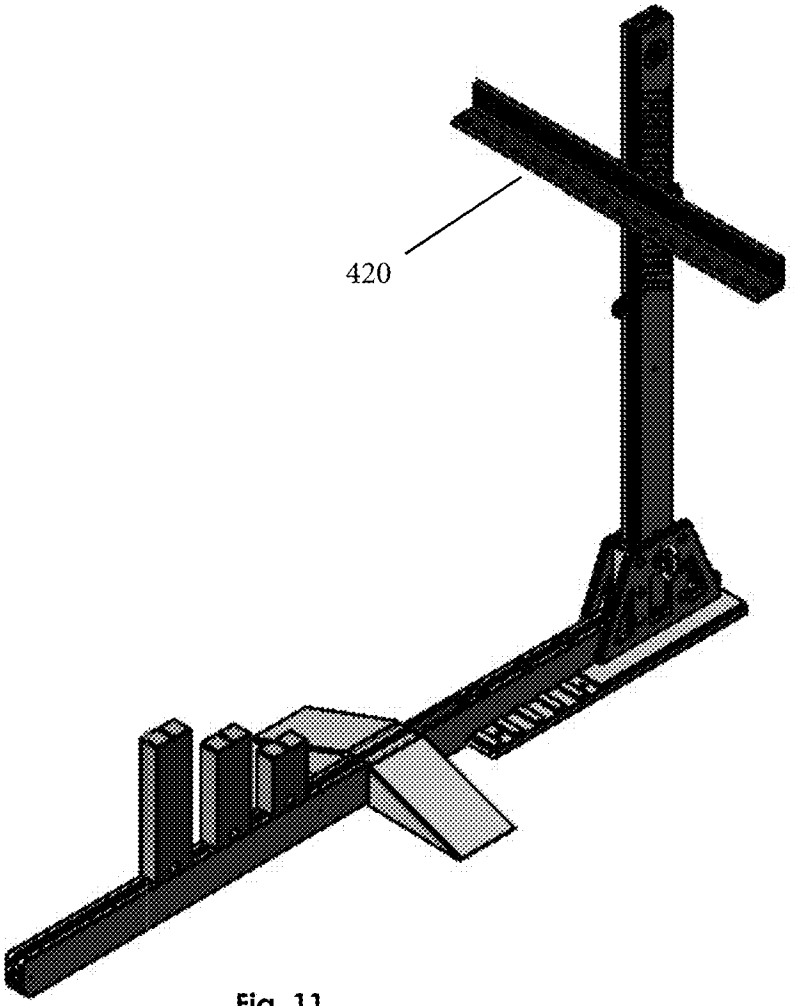
FIG. 11 is an illustration of a third embodiment of the invention.
Figure 12:
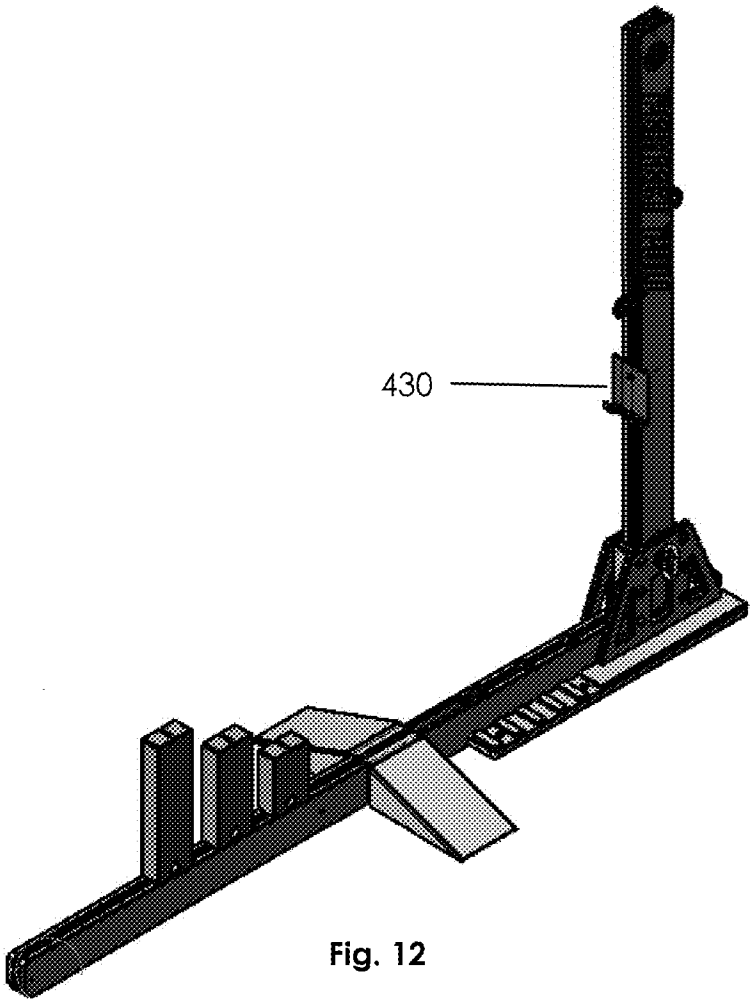
FIG. 12 is an illustration of a fourth embodiment of the invention.

FIGS. 11 and 12 further illustrate two additional alternate embodiments. The embodiment set forth in FIG. 11 includes a cross-bar 420. The horizontally mounted cross-bar 420 provides additional points of attachment and may be set at any angle along the vertical support beam 220. The embodiment set forth in FIG. 12 includes a hangar 430. The hangar 430 may be mounted at any height on the beam 220 as well. When used in certain applications, it may serve to prevent the panel being repaired from bulging toward the tower.

While the invention has been described in reference to certain preferred embodiments, it will be readily apparent to one of ordinary skill in the art that certain modifications or variations may be made to the device without departing from the scope of invention described in the foregoing specification.

The invention claimed is:

1. A mobile anchor apparatus to assist with a repair of a body of an automobile or other vehicle having:

a planar base plate having a mounting frame on its top surface; said mounting frame having a receiving channel and a frame structure; said frame structure having a pair of parallel projections which extend from said top surface; said pair of parallel projections defining a mounting space therebetween;

a vertical support beam having a first end and a second end; said first end being fixed in place within said receiving channel but removably attached to said mounting frame by a quick-release pin; said vertical support beam having a plurality of mounting apertures positioned along two sides of said vertical support beam, front and rear channels running the length of the vertical support beam that terminate at apertures on either end of the beam thereby providing an open area within the vertical support beam within which at least one handle is secured; the handle having a projection that is received within an opening in the front or rear channel;

a chain hoist attached to at least a portion of said handle;

a foot rail being partially situated within said mounting space and, further, extending orthogonally from said mounting space; said foot rail being removably attached to said planar base plate and having a top surface and a bottom surface; said foot rail having a mounting groove which extends along the top surface of at least a portion of the foot rail; and, at least one jack block removably mounted in said mounting groove; said at least one jack block having a tang which slides into said mounting groove wherein said at least one jack block is disposed to receive at least a portion of a weight of said automobile or other vehicle.

2. A mobile anchor apparatus to assist with a repair of a body of an automobile or other vehicle having:

a planar base plate having a mounting frame on its top surface; said mounting frame having a receiving channel and a frame structure; said frame structure having a pair of parallel projections which extend from said top surface; said pair of parallel projections defining a mounting space therebetween;

a vertical support beam having a first end and a second end; said first end being fixed in place within said receiving channel but removably attached to said mounting frame by a quick-release pin; said vertical support beam having a plurality of mounting apertures positioned along two sides of said vertical support beam, front and rear channels running the length of the vertical support beam that terminate at apertures on either end of the beam thereby providing an open area within the vertical support beam within which at least one handle is secured; the handle having a projection that is received within an opening in the front or rear channel;

a come-along attached to at least a portion of said handle;

a foot rail being partially situated within said mounting space and, further, extending orthogonally from said mounting space; said foot rail being removably attached to said planar base plate and having a top surface and a bottom surface; said foot rail having a mounting groove which extends along the top surface of at least a portion of the foot rail; and, at least one jack block removably mounted in said mounting groove; said at least one jack block having a tang which slides into said mounting groove wherein said at least one jack block is disposed to receive at least a portion of a weight of said automobile or other vehicle.

3. A mobile anchor apparatus to assist with a repair of a body of an automobile or other vehicle having:

a planar base plate having a mounting frame on its top surface; said mounting frame having a receiving channel and a frame structure; said frame structure having a pair of parallel projections which extend from said top surface; said pair of parallel projections defining a mounting space therebetween;

a vertical support beam having a first end and a second end; said first end being fixed in place within said receiving channel but removably attached to said mounting frame by a quick-release pin; said vertical support beam having a plurality of mounting apertures positioned along two sides of said vertical support beam, front and rear channels running the length of the vertical support beam that terminate at apertures on either end of the beam thereby providing an open area within the vertical support beam within which at least one handle is secured; the handle having a projection that is received within an opening in the front or rear channel;

a winch attached to at least a portion of said handle;

a foot rail being partially situated within said mounting space and, further, extending orthogonally from said mounting space; said foot rail being removably attached to said planar base plate and having a top surface and a bottom surface; said foot rail having a mounting groove which extends along the top surface of at least a portion of the foot rail; and, at least one jack block removably mounted in said mounting groove; said at least one jack block having a tang which slides into said mounting groove wherein said at least one jack block is disposed to receive at least a portion of a weight of said automobile or other vehicle.

4. The mobile anchor apparatus of claim 3 wherein said winch comprises a hand-operated winch.

5. The mobile anchor apparatus of claim 3 wherein said winch comprises an automated winch.

* * * * *